US006766556B2

(12) United States Patent
Gergek

(10) Patent No.: US 6,766,556 B2
(45) Date of Patent: Jul. 27, 2004

(54) APPARATUS FOR CLEANING SURFACES WITH AUTOMATIC WATER SUPPLY AND DRAIN

(76) Inventor: Franc Gergek, 55 West Beaver Creek Road, Unit 14, Richmond Hill, Ontario (CA), L4B 1K5

( * ) Notice: Subject to any disclaimer, the term of this patent is extended or adjusted under 35 U.S.C. 154(b) by 249 days.

(21) Appl. No.: 10/093,729

(22) Filed: Mar. 11, 2002

(65) Prior Publication Data

US 2002/0129459 A1 Sep. 19, 2002

Related U.S. Application Data

(60) Provisional application No. 60/275,130, filed on Mar. 13, 2001.

(51) Int. Cl.[7] ..... A47L 11/30
(52) U.S. Cl. ..... 15/320; 15/322
(58) Field of Search ..... 15/320, 322

(56) References Cited

U.S. PATENT DOCUMENTS

| | | | | |
|---|---|---|---|---|
| 919,606 A | | 4/1909 | Locke et al. | |
| 1,821,715 A | | 9/1931 | Kuchinsky | |
| 2,292,435 A | | 8/1942 | Crites | |
| 2,506,077 A | | 5/1950 | Goldsmith | |
| 2,885,713 A | * | 5/1959 | Morrill | 15/322 |
| 3,184,780 A | | 5/1965 | Hageman | |
| 3,616,482 A | | 11/1971 | Brycki | |
| 3,705,437 A | | 12/1972 | Rukavina, Jr. et al. | |
| 3,747,155 A | * | 7/1973 | Koellisch | 15/322 |
| 3,808,631 A | | 5/1974 | Shibata et al. | |
| 3,939,527 A | | 2/1976 | Jones | |
| 3,940,826 A | | 3/1976 | Phillips et al. | |
| 4,083,077 A | | 4/1978 | Knight et al. | |
| 4,274,676 A | | 6/1981 | Chapel | |
| 4,353,145 A | | 10/1982 | Woodford | |
| 4,378,611 A | | 4/1983 | Ninehouser | |
| 4,458,377 A | | 7/1984 | Frohbieter | |
| 4,741,069 A | * | 5/1988 | Helm et al. | 15/320 |
| 4,872,920 A | * | 10/1989 | Flynn et al. | 134/21 |
| 4,951,346 A | | 8/1990 | Salmon | |
| 5,004,428 A | | 4/1991 | Hayden | |
| 5,060,342 A | | 10/1991 | Brazier | |
| 5,551,117 A | * | 9/1996 | Bamman | 15/302 |
| 5,613,270 A | * | 3/1997 | Alvarez et al. | 15/320 |
| 6,009,593 A | | 1/2000 | Crouser et al. | |
| 6,055,699 A | | 5/2000 | Cho | |
| 2001/0000576 A1 | * | 5/2001 | Robinson | 134/169 C |

FOREIGN PATENT DOCUMENTS

| | | |
|---|---|---|
| DE | 26 15 501 | 10/1977 |
| EP | 0 262 022 | 3/1988 |

* cited by examiner

*Primary Examiner*—Terrence R. Till
(74) *Attorney, Agent, or Firm*—Ogilvy Renault; Wayne H. Yan

(57) ABSTRACT

An apparatus for cleaning floor surfaces and the like includes a cleaning head and a vacuum head to apply water on the surface for a continuous cleaning and vacuum operation. A single water passage of the apparatus is adapted to be connected to an automatic central water supply and drain system to supply water to and withdraw used water from the apparatus alternately through the single water passage in a controlled manner. Fresh water and used water containers are provided for temporarily storing the fresh and used water respectively. A valve device is used to selectively direct the water flow from the single water passage to the fresh water container and water flow from the used water container to the single water passage. Dirt particles are separated from water and air, and are collected in a removable bin for periodic dumping. The apparatus of the invention assures a fully automatic and efficient wet cleaning and vacuuming operation.

16 Claims, 6 Drawing Sheets

APPARATUS FOR CLEANING SURFACES WITH AUTOMATIC WATER SUPPLY AND DRAIN

CROSS-REFERENCE TO RELATED APPLICATIONS

This patent application claims the benefit of Applicant's provisional patent application 60/275,130, filed on Mar. 13, 2001.

THE FIELD OF THE INVENTION

The present invention relates to an apparatus for cleaning surfaces such as floors and the like, is more particularly directed to an apparatus for cleaning surfaces with an automatic water supply and drain system.

BACKGROUND OF THE INVENTION

Cleaning systems that circulate and spray liquids are widely used for cleaning carpets, upholstery, fabric, wall coverings and hard surfaces such as floors of concrete and ceramic tile, etc. In one such system, known as continuous flow cycling, a liquid cleaning solution is sprayed toward the surface being cleaned. A vacuum source simultaneously creates a high velocity air stream that draws the atomized liquid toward the surface, along the surface, or into the material in the case of carpeting, then upwardly away from the surface. This extracts soil, debris and other foreign materials along with the cleaning solution. A typical example of such cleaning systems is described in U.S. Pat. No. 6,055,699, issued to Cho on May 2, 2000. Cho's system includes a tank and a cleaning tool head that is coupled to the tank by a vacuum hose and by a liquid supply tubing. In operation a liquid cleaning solution is supplied through the liquid supply tubing to a lower row of nozzles of the cleaning tool head spray the liquid onto the surface to be cleaned through a chamber of the cleaning tool head. At the same time, a motor in the tank is operated to draw a vacuum through the vacuum hose that is in fluid communication with the chamber of the tool. However, in such a recycling manner, the liquid cleaning solution is reused within a period of time and therefore the cleaning result will be adversely affected if the cleaning liquid in the tank is not frequently replaced and the tank is not properly cleaned each time.

Another type of surface cleaning system not recycling the cleaning liquid will overcome the above mentioned shortcomings. U.S. Pat. No. 919,606, issued to Rocke et al. on Apr. 27, 1909 describes a central vacuum cleaning system having suction pipes and water supply pipes installed in a building structure and accessible at each floor of the building. A cleaning head having a brush, water passage and vacuum passage with a nozzle is provided to be connected to the water pipes and the suction pipes by means of a flexible water tubing and vacuum hose which extend from the cleaning head. In operation Rocke et al.'s central vacuum system having been started, a vacuum is created in the vacuum hose. When the valve of the water passage is opened, a stream of water is carried from the supply tubing to the brush to allow the operator to flush the floor or surface being cleaned at the same time to loosen the dirt by the usual scrubbing operation. When the dirt is loosened from the surface being cleaned and is thoroughly mixed with the water, the water is shut off and the vacuum nozzle is pressed down into close proximity with the surface or floor, in order to allow the water and dirt to be drawn through the vacuum passage into the central system. However, during Rocke et al.'s scrubbing operation to clean and loosen the dirt, most loosened particles and water cannot be drawn into the system because the vacuum nozzle is not pressed down into close proximity with the surface, and therefore the operation is not continuous and efficient. Additionally, the dirt mixed with the used water will be drawn into the central vacuum system which results in difficulty cleaning the dirt remaining in the vacuum pipes especially when the dirt is allowed to dry therein.

Therefore, there is a need for an improved surface cleaning apparatus which overcomes the shortcomings of the prior art.

SUMMARY OF THE INVENTION

One object of the present invention is to provide an apparatus for cleaning a surface, which is adapted for use with a liquid supply and drain system to achieve automatic liquid supply and drain during a surface cleaning operation.

Another object of the present invention is to provide an apparatus for cleaning a surface having a single liquid passage alternately to supply fresh liquid for the cleaning and to remove the used liquid during a continuous cleaning and vacuuming operation.

In accordance with one aspect of the present invention, an apparatus for cleaning a surface is provided. The apparatus includes a cleaning head for applying a liquid onto the surface and cleaning same, and a vacuum head for removing a mixture of used liquid, air and particles from the surface under a vacuum action. A fan device is provided for generating the vacuum action of the vacuum head. Means are provided for separating the used liquid, air and particles from the mixture respectively, and containing the separated particles. A used liquid container is provided for containing a volume of the used liquid separated from the mixture. A single liquid passage which is adapted to be connected at a first end thereof to an external liquid supply and drain system has valve means at a second end thereof for establishing selective fluid communication of the single liquid passage with one of the cleaning head and the used liquid container. Thus, the liquid can be supplied to the cleaning head and the used liquid can be withdrawn from the used liquid container alternately through the single liquid passage A liquid supply container is preferably provided for containing a volume of liquid and supplying the liquid to the cleaning head. The valve means of the single liquid passage are connected to both the liquid supply container and the used liquid container for selective fluid communication of the single liquid passage with one of the liquid supply container and the used liquid container, so that liquid can be supplied to the liquid supply container and the used liquid can be withdrawn from the used liquid container alternately through the single liquid passage in a controlled manner in order to assure a continuous cleaning and vacuuming operation.

A casing structure is preferably provided which has a open bottom and houses the cleaning head, vacuum head, the liquid supply container and the used liquid container, the separating means and the fan device. The cleaning head and the vacuum head are exposed at the open bottom to the surface being cleaned. The single liquid passage is preferably formed with a hollow section of a handle which is pivotally attached to the casing and has a hose extension so that the free end of the hose can be connected to a wall outlet of the external liquid supply and drain system while the apparatus is being used for cleaning an indoor surface such as floors and the like.

Sensors are preferably installed in the liquid supply container and the used liquid container for sensing the liquid level and are adapted to be electrically connected to the external liquid supply and drain system. Electrical conductors for delivering electric current to power the apparatus and for transmitting electrical signals from the apparatus to the external liquid and supply system are preferably incorporated with the hose which forms a section of the single liquid passage.

The apparatus of the present invention assures an efficient continuous cleaning and vacuuming operation and eliminates the need to manually supply and drain cleaning liquid such as water.

Other advantages and features of the present invention will be better understood with reference to preferred embodiments of the invention described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENT

Figure 1:
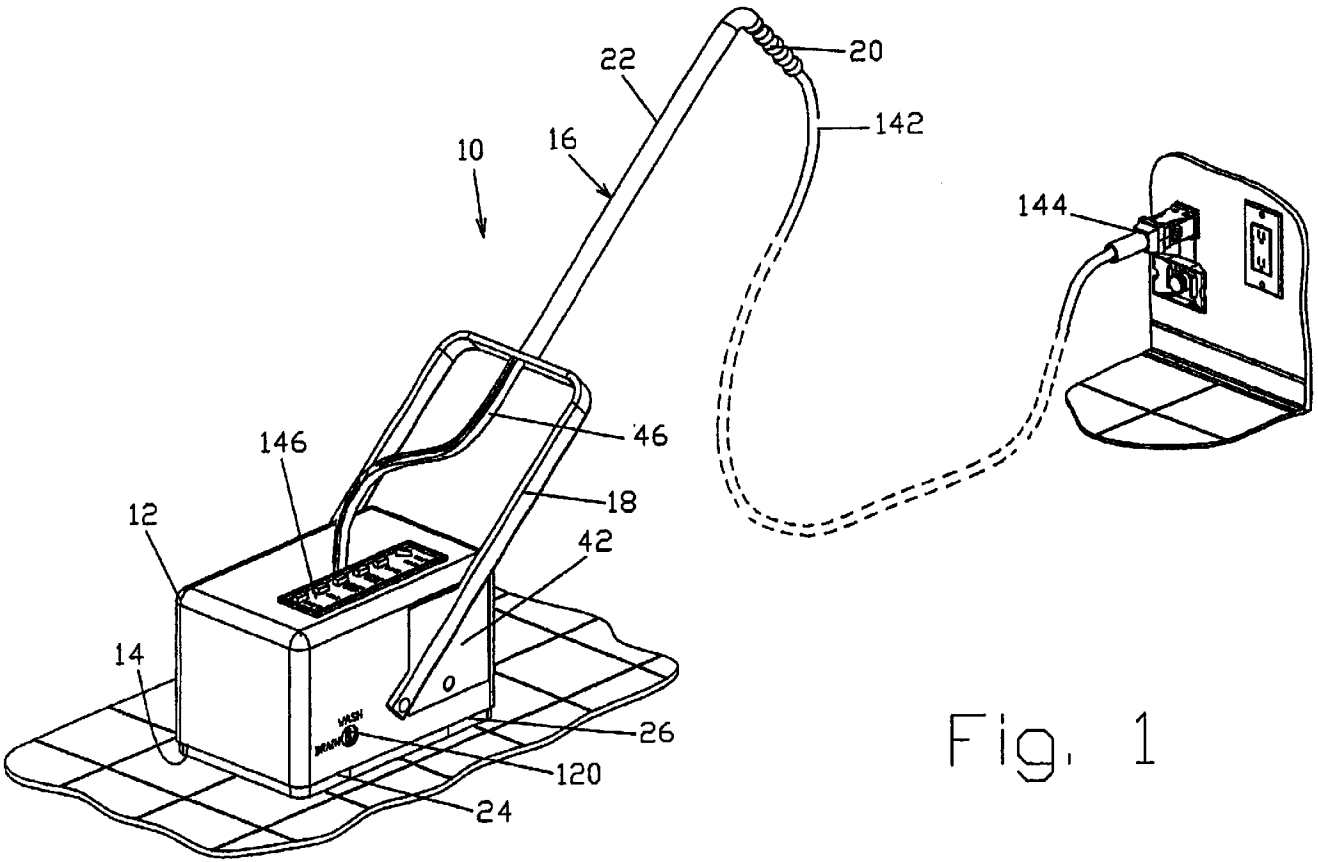
FIG. 1 is a perspective view of an apparatus for cleaning surfaces in accordance with one embodiment of the present invention.
Figure 2:
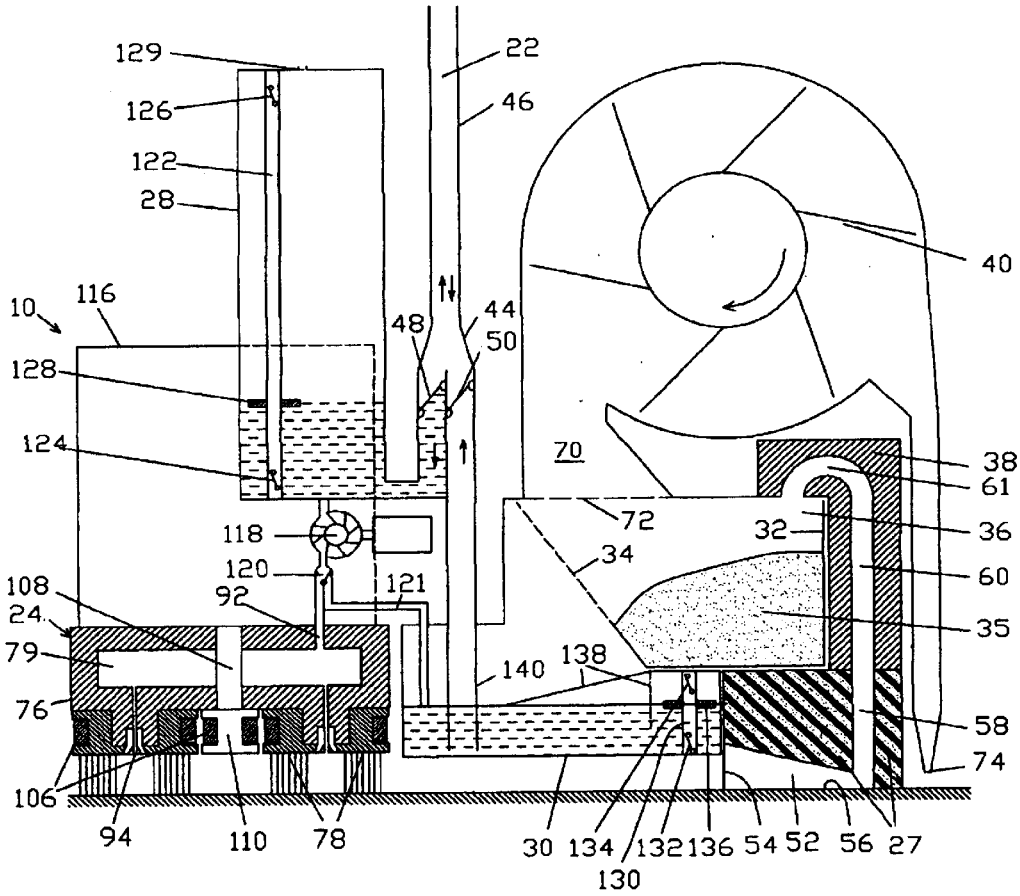
FIG. 2 is a schematic cross-sectional illustration showing various components of the apparatus of FIG. 1.

Referring now to the drawings, particularly FIGS. 1 and 2, an apparatus which is capable of washing the floor and removing sand and other dirt particles from the floor surface is generally indicated by numeral 10. The apparatus 10 includes a casing structure 12 having an open bottom 14, and a handle 16. The handle 16 has a forked section 18 at one end thereof which is pivotally attached to opposite sides of the casing 12 and a gripping section 20 at the other end thereof, so that the apparatus 10 can be conveniently pushed or pulled to move on the floor surface by a user gripping the handle 16 at various angular positions. A main section of the handle 16 between the forked section 18 and the free end is hollow, forming a single water passage 22.

The apparatus 10 further includes a cleaning head 24 and a vacuum head 26 both of which are supported by the casing 12 and are exposed to the floor surface at the open bottom 14 of the casing 12. A first container 28 is provided above the cleaning head 24 for containing a volume of cleaning liquid, such as water and for supplying the water to the cleaning head 24. A second container 30 is provided at a lower position within the casing 12 but is spaced apart from the floor when the cleaning head 24 and the vacuum head 26 contact the floor surface. The second container 30 is used for containing a volume of the used water. A bin 32 is removably supported within the casing 12 and is positioned above the vacuum head 26 and the second container 30. The bin 32 having a mesh 34 attached on its inner side works as a depository for collecting sand and other dirt particles 35 and permitting used water to drain through the mesh 34 into the second container 30. The bin 32 is slidably received in an enclosure 36 defined by the second container 30, the vacuum head 26, a body member 38 and a fan device 40, and can be slidably removed from the enclosure 36, through an opening (not shown) in one side of the casing 12 when a cover member 42 in the side of the casing 12 is opened so that sand and dirt particles 35 collected in the bin 32 can be periodically dumped from the open top of the bin 32.

A connecting hose 46 interconnects the major hollow section of the handle 16 and both the first and second containers 28, 30 by means of a three-way connector 44. The three-way connector 44 has a first opening (not indicated) connected to the first container 28, a second opening (not indicated) connected to the second container 30, and a third opening (not indicated) connected to the interconnecting hose 46 which also forms a section of the single water passage 22. A first one-way valve 48 is positioned in the first opening of the three-way connector 44 to permit water to flow only from the single water passage 22 to the first container 28 but not in reverse, and a second valve 50 is positioned in the second opening of the three-way connector 44 to permit water to flow only from the second container 30 to the single water passage 22 but not in reverse.

Figure 3:
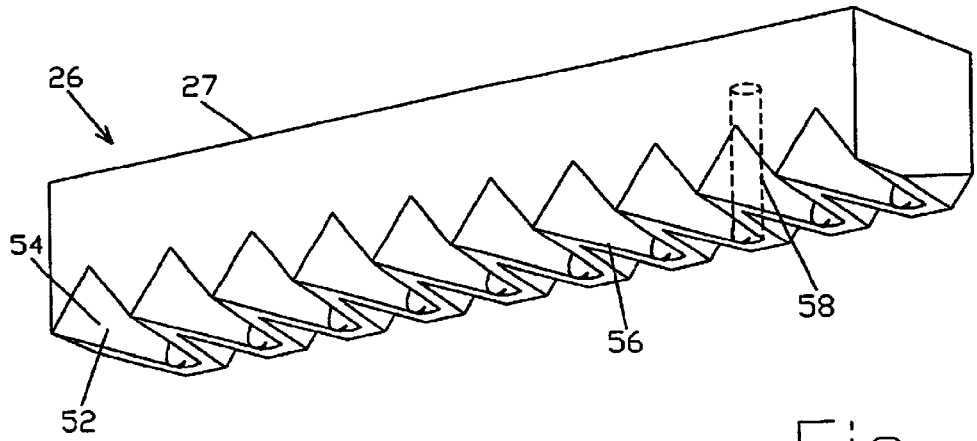
FIG. 3 is a perspective view of a vacuum head of the apparatus of FIG. 1.
Figure 5:
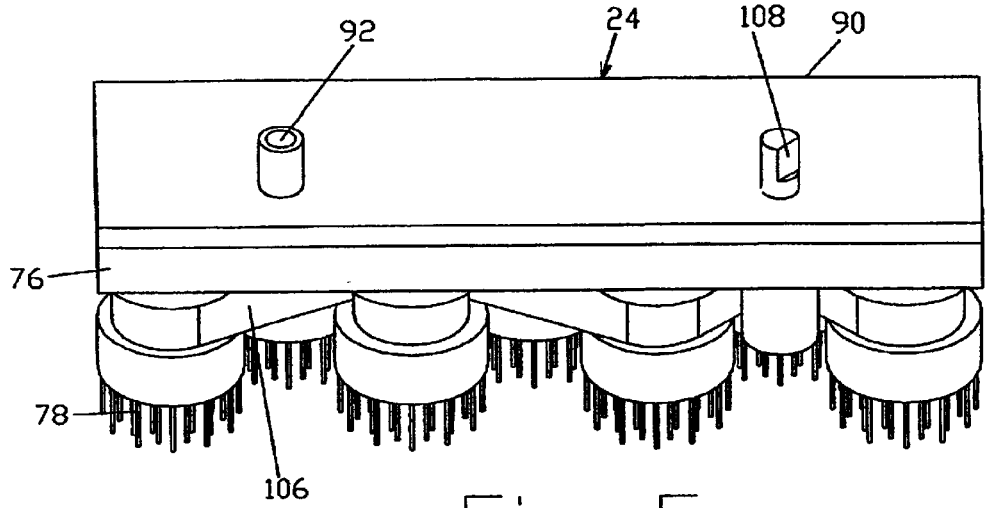
FIG. 5 is a perspective view of the cleaning head of the apparatus of FIG. 1.
Figure 6:
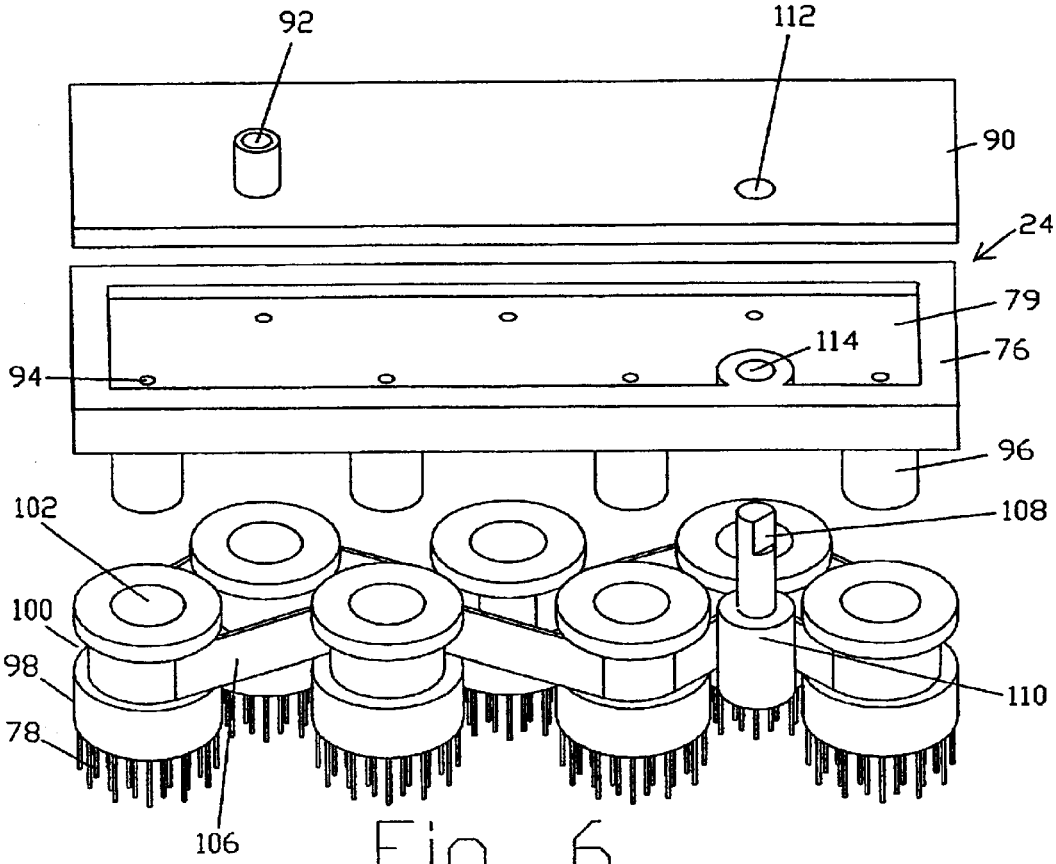
FIG. 6 is an exploded perspective view of the cleaning head of FIG. 5, showing the details of a drive chain for rotating the brushes.
Figure 7:
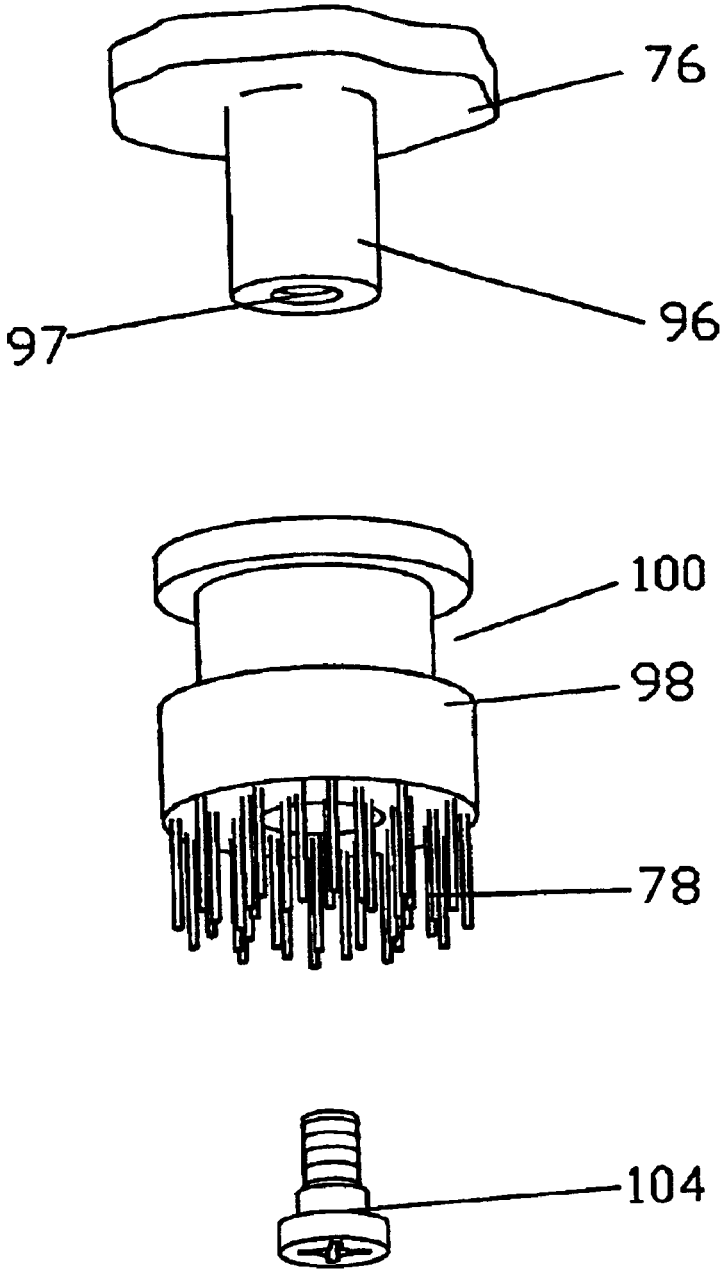
FIG. 7 is an exploded view of a single rotatable brush of the cleaning head of FIG. 5.

Reference will now be made to FIGS. 2 and 3. The vacuum head 26 generally includes a single piece of sponge 27 having a plurality of cavities 52 at the bottom thereof which contacts the floor surface. Each cavity 52 has a substantially triangular cross-section having an opening 54 at the inner side of the sponge 27, a main opening 56 in the bottom of the sponge 27 and a round hole 58 (only one shown by broken lines in FIG. 3) extending from the top of the cavity 52 vertically through the sponge 27. Thus, the side opening 54 forms an inlet of the vacuum head 26 for receiving a mixture of water, air and dirt particles under a vacuum action and the hole 58 forms an outlet for discharging the mixture when the main opening 56 of each cavity 52 is covered by the floor surface being cleaned.

The one-piece sponge 27 is removablly attached to the casing 12 of FIG. 1 and the second container 30 so that the sponge 27 can be conveniently replaced when required.

Figure 4:
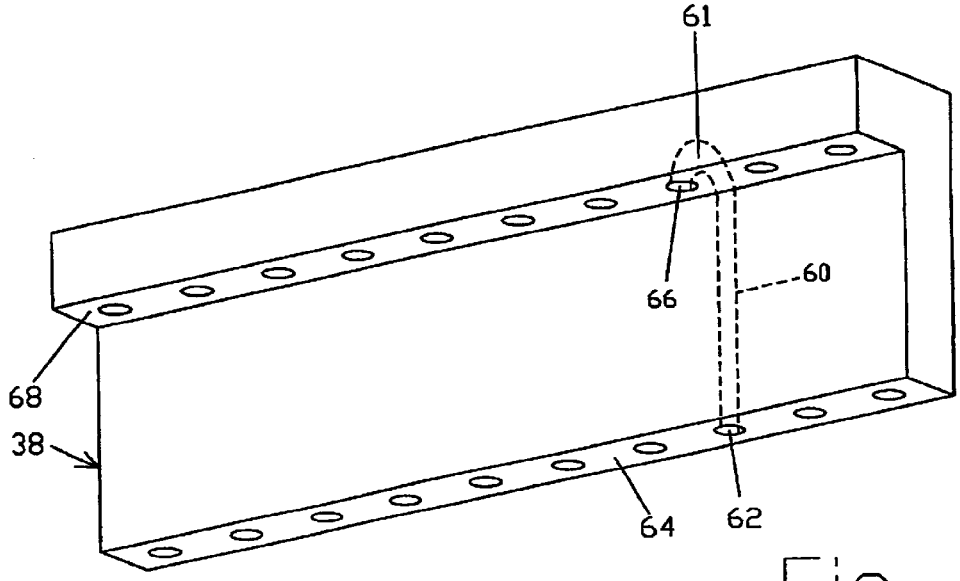
FIG. 4 is a perspective view of a body member of the apparatus of FIG. 1.

The body member 38 which is supported within the casing 12 of FIG. 1 and is positioned on the top of the vacuum head 26, includes a single piece in an L-shape having a plurality of fluid passages 60 (only one shown by broken lines in FIG. 4). Each fluid passage 60 has an opening 62 in a lower bottom surface 64 of the L-shaped body member 38 and an opening 66 in an upper bottom surface 68 of the body member 38. The openings 62 of the body member 38 are aligned with and in fluid communication with the vertical holes 58 of the sponge 27 and the openings 66 are positioned at the top of the bin 32 near an outer side thereof and are in fluid communication with the bin 32. The fluid passage 60 includes a curved section 61 near the opening 66 to direct the mixture flow drawn from the vacuum head 26 downwards into the bin 32.

A fan inlet 70 is positioned at the top of the bin 32 near its inner side, and is in fluid communication with the bin 32. An air filter 72 is preferably provided within the fan inlet 70. The fan device 40 further includes a plurality of exhaust nozzles 74 which extend downwardly along the body member 38 and the vacuum head 26 and are positioned close to the floor surface being cleaned. The fan device 40 which is also supported within the casing 12 of FIG. 1 is designed in a configuration to define, in combination with the second container 30, the vacuum head 26 and the body member 38, the relatively sealed enclosure 36 so that a vacuum action generated by the fan device 40 is effective at the vacuum head 26 through the passage formed by the holes 58, passages 60 and the enclosure 36.

Reference will now be made to FIGS. 2, 5, 6 and 7. The cleaning head 24 includes a base body 76 for supporting a plurality of rotatable brushes 78. The base body 76 defines a chamber 79 having an open top which is covered by a base cover 90. The base cover 90 includes an inlet 92 for receiving fresh water and a plurality of small openings 94 extending through the bottom of the base body 76 so that fresh water entering the inlet 92 will spread throughout the chamber 79 and be discharged from the small openings 94, onto the floor surface to be cleaned.

A plurality of cylindrical extensions 96 extend downwards from the bottom of the base body 76 and each of the extensions 96 includes a threaded mounting bore 97 in its bottom end.

Each rotatable brush 78 includes a cylindrical body 98 having an annular groove 100 and a central hole 102 extending through the cylindrical body 98. Each brush 78 is rotatably attached to the base body 76 by receiving the cylindrical extension 96 extending through the central hole 102 of the brush body 98 and being held in position by a shoulder screw 104 that engages the threaded mounting bore 97 in the end of the cylindrical extension 96. The rotatable brushes 78 are rotated by an endless flat belt 106 which is positioned partially around each of the brush bodies 98 and is tensioned to maintain a tight contact with each brush body 98. The belt 106 is axially restrained within the grooves 100 of the of the brush bodies 98. A driving shaft 108 which extends through an opening 112 in the base cover 90 and an opening 114 in the base body 76 has a pulley 110 at the bottom end thereof. The flat belt 106 is also positioned partially around the pulley 110 and is tensioned in contact with the pulley 110 so that when the driving shaft 108 is coupled to a motor 116 and is driven by the motor 116, the pulley 110 will rotate all the rotatable brushes 78 by means of the flat belt 106.

A motor/pump assembly 118 is provided between the first container 28 and the cleaning head 24 to pump water from the first container 28 to the cleaning head 24. A valve 120 is provided in the outlet of the motor/pump assembly 118 for selectively directing water flow. The valve 120 has a first position in which the pumped water flow is directed through the inlet 92 into the chamber 79 of the cleaning head 24 for washing the floor surface being cleaned, and a second position in which the pumped water flow from the first container 28 is directed into the second container 30 through a by-pass passage 121.

A vertical rod 122 is installed in the first container 28 with two built in switches 124, 126. Switch 124 is in a lower position at about 10% of the height of the first container 28 and switch 126 is in an upper position at about 90% of the height of the first container 28. Around the rod 122 is provided a float member 128 with a built-in magnet (not shown) that activates the switches 124 and 126 when the float member 128 approaches the switches respectively. An opening 129 is provided at the top of the first container 28 to permit air to flow in and out when water level in the first container 28 changes.

Similarly, a vertical rod 130 is installed in the second container 30 with two built in switches 132 and 134. Switch 132 is in a lower position at about 5% height of the second container 30 and switch 134 is in an upper position at about 75% of the height of the second container 30. A float member 136 with a built-in magnet (not shown) is positioned around the vertical rod 130 to activate switches 132, 134 when approaching the switches respectively. Guiding plates 138 are provided to prevent the used water drained from the bin 32 from flowing over the float member 136 because sand residues can obstruct the free movement of the float member 136. It also should be noted that a pipe 140 connected to the three-way connector 44 of the single water passage 22 and extending into the second container 30 should reach close to the bottom thereof to ensure a substantially complete withdrawal of the used water from the second container 30.

Referring to FIGS. 1 and 2, when the cleaning operation begins, the motor/pump assembly 118 starts to pump water from the first container 28 through the outlet 92 into the chamber 79 of the cleaning head 24. At this moment, the valve 120 is positioned to close the by-pass passage 121. The water in the chamber 79 flows down through the openings 106 onto the floor surface being cleaned. At the same time the motor 116 drives brushes 78 in rotation which scrub the wet floor surface and loosens dirt particles from the floor surface. Meanwhile, apparatus 10 is being pushed forward to the left so that the cavities 52 of the sponge 27 of the cleaning head 26 push water mixed with sand and other dirt particles on the floor surface towards the narrow end of the cavities 52 to be vacuumed.

A vacuuming operation is conducted simultaneously. A powerful motor (not shown) drives the fan device 40 to generate high air flow from the vacuum head 26 through the fan device 40. The air flow is concentrated on the inner side openings 54 of cavities 52 of the vacuum head 26 to create a powerful vacuum action which is capable of lifting water and dirt particles from the floor surface being cleaned, and mixed with air. The air flow having relatively high velocity carries used water and dirt particles through the narrow passages formed by the vertical hose 58, and passages 60 and is directed downwards through the curved section 61 into the bin 32. Because the cross-section of the bin 32 is much larger than the total cross-section of the narrow passages formed by vertical hose 58, and passages 60, the velocity of the air flow is much smaller, only about 1/20 or 1/100 of the velocity of the air flow in the passages formed by vertical hose 58, and passages 60. When entering the bin 32 the air flow substantially loses its momentum resulting from the high velocity thereof, and the used water and dirt particles carried by the air flow will fall down under their own weight while the air flow at a relatively low velocity is being drawn up through the air filter 72 to enter the inlet 70 of the fan device 40. The dirt articles 35 are collected within the bin 32 while the used water is draining through the mesh 34 into the second container 30. The air flow entering the inlet 70 of the fan device 40 is directed into the relatively narrow nozzles 74 so that the exhausting air flow from nozzles 74 will have a relatively high velocity and impinge the floor surface that has just been cleaned in order to facilitate the drying of the cleaned floor surface.

The apparatus is connected to a central water supply and drain system (not shown) through a hose 142 and a connector assembly 144 which is attached to a wall outlet of the system. The system includes a hydro-electrical device with a controller and is adapted to supply water under pressure and withdraw water under a vacuum action through a single water pipe which terminates at the wall outlet. The central water supply and drain system is fully automated according to predetermined programs and electrical signals sent from sensors attached with user apparatus, such as switches 124, 126, 132 and 134 of the apparatus 10. This system is fully described in Applicant's co-pending U.S. patent application Ser. No. 10/093,509 entitled REMOTE CONTROLLED WATER FLOW AND DRAIN SYSTEM and filed on Mar. 11, 2002now U.S. Pat. No. 6,568,425, the entire specification of which is incorporated herein by reference. Electrical conductors for transmitting electrical signals from the switches 124, 126, 132 and 134 as well as for delivering electrical current to power the motors for the fan device 40 and the motor/pump 118 can be incorporated into the hose 142 and terminate at the connector assembly 144 which in combination with the wall outlet is used to establish a quick and safe fluid and electrical connection. This combined connector is fully described in the Applicant's co-pending U.S. patent application Ser. No. 10/93,505 entitled COMBINED CONNECTOR FOR FLUID AND ELECTRICAL CONNECTION, and filed on Mar. 11, 2002now U.S. Pat. No. 6,685,491 , the entire specification of which is incorporated herein by reference. A control pad 146 is provided on the top of the casing 12 for the user to manually initiate and terminate a cleaning operation. The valve 120 is located at one side of the casing 12 so that the valve 120 is accessible for a manual operation.

Figure 8:
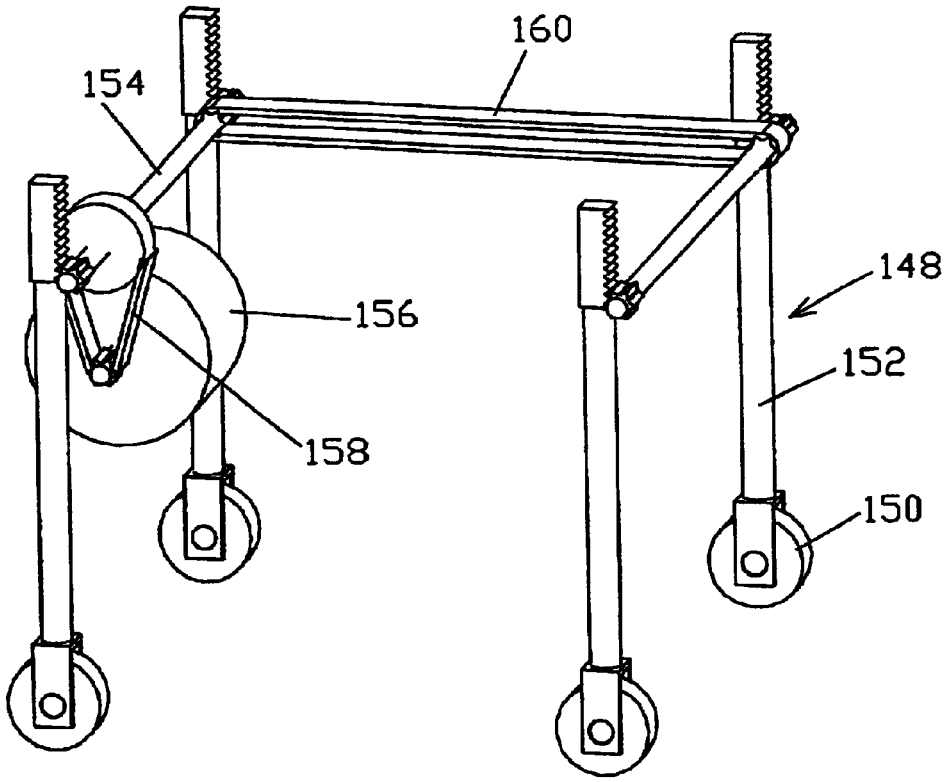
FIG. 8 is a perspective view of a wheel assembly for adjustably supporting the apparatus of FIG. 1 to facilitate the movement thereof.

Referring to FIGS. 1, 2 and 8, a retractable wheel assembly 148 is provided to facilitate the movement of apparatus 10 either in a cleaning direction (toward the left of FIG. 2) or in an idle direction (toward the right of FIG. 2). The wheel assembly includes four wheels 150 rotatably supported by four vertical rods 152 with racks at the top thereof. The four rods 152 are adjustably supported to the casing 12 and are driven by two shafts 154 which have pinions at the ends thereof and rotatably supported by the casing 12. The shafts 154 are driven by a motor 156 supported by the casing 12 through belts 158, 160.

The cleaning head 24 and the vacuum head 26 are preferably supported by spring means (not shown) to the casing 12. When the apparatus 10 is moved in the cleaning direction, the motor 156 being controlled by the control pad 146, drives the wheels 150 up to a predetermined position so that both the rotatable brushes 78 and sponges 27 contact the floor surface under a spring force while the apparatus 10 is moving on the wheels 150. When the apparatus 10 is moved in the idle direction, the motor 156, being controlled by the control pad 146, drives the wheels 150 down to lift the rotatable brushes 78 and sponge 27 from the floor surface. This operation can be fully automated, for example, by sensors (not shown) incorporated into the handle 16, sensing a pulling and pushing force on the handle, and sensing the pivotal side of the handle 16 with respect to the casing 12. The control pad 146 will control the position of the wheels 150 in response to the signals from these sensors.

During cleaning of the floor surface the water contained in the first container 28 is being used and air is entering the first container 28 through opening 129. When the water level in the first container 28 drops to the level of the switch 124, switch 124 is activated to signal the central water supply and drain system to pump water through the single water passage 22. Under the water pressure in the single water passage 22, valve 50 is pressed closed and valve 48 is pressed open so that the water can only be directed into the first container 28. Opening 129 on the top of the first container 28 permits air to escape when the first container 28 is filling with water. When the water level reaches the switch 126, the switch 126 signals the central water supply and drain system to turn off its pump.

Also, during cleaning of the floor, the used water is being collected in the second water container 30. When the water level in the second container 30 rises to the level of switch 134 the switch 134 signals the central water supply and drain system to start its pump in reverse to generate a vacuum action in the single water passage 22. Being effected by the vacuum action in the single water passage 22, the valve 48 closes and the valve 50 opens so that used water in the second container 30 is removed under the vacuum action through the single water passage 22 into the central water supply and drain system and will be directed into a proper drainage.

The system is fully automated such that when the system receives a signal for a water withdrawal request while the system is pumping water through the single water passage 22 into the first container 28, the system will immediately reverse its pump and switch to a water withdrawal operation to ensure an immediate water withdrawal from the second container 30. Similarly, when the system receives a water supply signal while the system is withdrawing water from the second container 30 through the single water passage 22, the system will immediately reverse its pump and switch into a water supply operation to ensure the immediate water supply to the first container 28. Thus, a continuous cleaning and vacuuming operation of the apparatus 10 will not be interrupted for water supply or used water removal.

It is noted that a volume of used water remains in the single water passage 22 when fresh water is to be pumped into the first container 30 so that the volume of used water remaining in the single water passage 22 is pumped together with the fresh water into the first container 28. However, this will not cause any problems for the cleaning and vacuuming operation and does not substantially affect the cleaning performance. Nevertheless, this problem can be overcome by using a valve 50 which can be closed only when the pressure in the single water passage 22 is above a certain level and a valve 48 which can be only opened when the pressure in the single water passage 22 is above the same level. With such valves 48, 50 the central water supply and drain system is programmed such that at the beginning of each water supply operation, the system will pump the water under a limited pressure level for a short period of time to ensure that the used water remaining in the single water passage 22 should be pumped back to the second container through the opened valve 50 while the valve 48 remains closed. After the predetermined short period of time the system pumps water through the single water passage 22 at a higher pressure to ensure that the valve 50 is pressed closed and the valve 48 is pressed open to direct the fresh water into the first container 28.

After a cleaning operation is completed, the user can manually switch the valve 120 at the side of casing 12 to drain unused water in the first container 28 through the by-pass passage 121 into the second container 30, and then manually start a water withdrawal operation by using the control pad 146 on the casing 12 to remove water from the second container 30. During this water withdrawal operation, the system will disregard the signal sent by switch 132 and terminate the water withdrawal operation only when the system detects a no-water condition in the single water passage 22. Thus, water can be substantially removed from the apparatus and the apparatus can be properly stored. The sand and other dirt particles collected in the bin 32 can be dumped periodically.

In another embodiment of the present invention the cleaning head 24 and vacuum head 26 can be formed as a tool head, but are separated from the other components of the apparatus 10. The tool head can be connected to the remaining components of the apparatus 10 by a flexible water supply tube and a vacuuming hose. So that the separated cleaning head 24 and vacuum head 26 are in a relatively compact shape which is convenient for moving around and cleaning corners.

In yet another embodiment of the present invention the cleaning head 24 does not include rotatable brushes and instead includes flanges (not shown) which in combination with the vacuum head 26 form coverage on the surface being cleaned. This type of cleaning head eliminates the scrubbing operation and is particularly for cleaning carpeting surfaces.

In a further embodiment of the present invention the apparatus 10 does not include the first container 28. The three-way connector 44 of the single water passage 22 is connected directly to the cleaning head 24 and to the second container 30 so that water can be supplied directly from the external central water supply system to the cleaning head 24 and the used water can be withdrawn from the second container 30 alternately through the single water passage 22. Thus, a continuous cleaning and vacuuming operation can be conducted until the second container 30 is filled up with the used water. A second continuous cleaning and vacuuming operation will begin after the used water is withdrawn from the second container 30.

Modifications and improvements to the above-described embodiments of the present invention may become apparent to those skilled in the art. For example, liquid detergent can be added into water either through the external central system or through an additional container attached to the apparatus. The foregoing description is intended to be exemplary rather than limiting. The scope of the invention is therefore intended to be limited solely by the scope of the appended claims.

I claim:

1. An apparatus for cleaning a surface comprising:

a cleaning head for applying a liquid onto the surface and cleaning same;

a vacuum head for removing a mixture of used liquid, air and particles from the surface under a vacuum action;

means for separating the used liquid, air and particles from the mixture respectively and containing the separated particles;

a fan device for generating the vacuum action of the vacuum head;

a used liquid container for containing a volume of the used liquid separated from the mixture; and a single liquid passage adapted to be connected at a first end to an external liquid supply and drain system, the single liquid passage having valve means at a second end thereof for establishing selective fluid communication of the single liquid passage with one of the cleaning head and the used liquid container, so that the liquid can be supplied to the cleaning head and the used liquid can be withdrawn from the used liquid container alternately through the single liquid passage.

2. An apparatus as claimed in claim 1 further comprising a liquid supply container for containing a volume of the liquid and supplying the liquid to the cleaning head, the valve means of the single liquid passage being connected to both the liquid supply container and the used liquid container for selective fluid communication of the single liquid passage with one of the liquid supply container and the used liquid container so that the liquid can be supplied into the liquid supply container and the used liquid can be withdrawn from the used liquid container alternately through the single liquid passage in a controlled manner in order to assure a continuous cleaning and vacuuming operation.

3. An apparatus as claimed in claim 2 wherein the fan device comprises an outlet directing exhaust airflow towards an area of the surface behind the vacuum head for drying the area.

4. An apparatus as claimed in claim 2 further comprising a liquid pump for pumping the liquid from the liquid supply container to the cleaning head.

5. An apparatus as claimed in claim 2 further comprising a drainage valve associated with the liquid supply container, the drainage valve having a first position which permits a liquid flow from the liquid supply container only to the cleaning head and a second position which permits a liquid flow from the liquid supply container only to the used liquid container.

6. An apparatus as claimed in claim 2 further comprising a plurality of liquid level sensors positioned in the respective liquid supply container and used liquid container and adapted to be electrically connected to the external liquid supply and drain system.

7. An apparatus as claimed in claim 2 wherein the valve means comprise a three-way connector having a first opening connected to the liquid supply container, a second opening connected to the used liquid container and a third opening connected to the second end of the single liquid passage, a first valve being positioned in the first opening permitting liquid to flow from the single liquid passage to the liquid supply container but not in reverse, a second valve being positioned in the second opening permitting liquid to flow from the used liquid container to the single liquid passage but not in reverse.

8. An apparatus as claimed in claim 2 wherein the cleaning head comprises at least one rotatable brush, an electrical motor for rotating the rotatable brush and a liquid passage for receiving the liquid from the liquid supply container and delivering the liquid to the rotatable brush.

9. An apparatus as claimed in claim 2 wherein the vacuum head comprises a sponge having at least one cavity in a bottom, the at least one cavity including a main opening, a side opening and a top opening so that the side opening forms an inlet for receiving the mixture, and the top opening forms an outlet connected to the separation means when the main opening is covered by the surface being cleaned.

10. An apparatus as claimed in claim 9 wherein the side opening of the at least one cavity of the sponge is positioned at an inner side of the sponge, towards the cleaning head.

11. An apparatus as claimed in claim 2 wherein the means for separating the liquid, air and particles from the mixture comprises a bin for collecting and storing the particles and permitting drainage of the used liquid therefrom into the used liquid container, the bin being in fluid communication at a first position of a top thereof with an inlet of the fan device and being in fluid communication at a second position of the top thereof with at least one narrow passage which is in fluid communication with the top opening of the at least one cavity of the sponge so that the used liquid and particles will drop down under their weight while air is being drawn up into the inlet of the fan device when a flow of the mixture enters the bin from the narrow passage and substantially loses the velocity thereof.

12. An apparatus as claimed in claim 11 wherein the bin is removable from the apparatus.

13. An apparatus as claimed in claim 2 further comprising a casing structure having an open bottom, the casing structure housing the cleaning head, the vacuum head, the liquid supply container and the used liquid container, the separating means and the fan device, and exposing the cleaning head and the vacuum head at the open bottom to the surface being cleaned.

14. An apparatus as claimed in claim 13 further comprising a handle pivotally attached to the casing, the handle having a hollow section forming a section of the single liquid passage, and being connected at an end thereof to a hose.

15. An apparatus as claimed in claim 14 wherein the hose is incorporated with electrical conductors for delivering electric current to power the apparatus and for transmitting electrical signals from the apparatus to the external liquid supply and drain system.

16. An apparatus as claimed in claim 15 wherein the hose and incorporated electrical conductors terminate with a combined connector for fluid and electrical connection.

* * * * *